US005706713A

United States Patent [19]

Lim

[11] Patent Number: 5,706,713

[45] Date of Patent: Jan. 13, 1998

[54] DECELERATING AIR PRESSURE CIRCUIT FOR AN AIR CYLINDER

[75] Inventor: Jong-Kuk Lim, Suwon, Rep. of Korea

[73] Assignee: Kia Motors Corporation, Seoul, Rep. of Korea

[21] Appl. No.: 691,659

[22] Filed: Aug. 2, 1996

[30] Foreign Application Priority Data

Jun. 28, 1996 [KR] Rep. of Korea ..... 96-25014

[51] Int. Cl.[6] ..... F15B 13/16

[52] U.S. Cl. ..... 91/361; 91/405; 91/458

[58] Field of Search ..... 91/361, 392, 405, 91/406, 458, DIG. 2

[56] References Cited

U.S. PATENT DOCUMENTS

| | | | |
|---|---|---|---|
| 3,363,514 | 1/1968 | Ramcke | 91/405 X |
| 4,132,153 | 1/1979 | Grotness et al. | 91/405 |
| 4,460,324 | 7/1984 | Appledorn | 91/361 X |

FOREIGN PATENT DOCUMENTS

| | | | |
|---|---|---|---|
| 1333919 | 10/1973 | United Kingdom | 91/361 |

*Primary Examiner*—Hoang Nguyen

[57] ABSTRACT

A decelerating air circuit having an air cylinder is disclosed. The decelerating air circuit includes a driving solenoid valve having an advance mode and a withdrawal mode. A decelerating solenoid valve having a high speed mode and a low speed mode has an outlet port connected to the decelerating solenoid valve. A constant speed flow control valve is attached to a low speed port of the decelerating solenoid valve. Limit switches are located respectively at an advance end and a withdrawal end of a piston rod of the air cylinder. Decelerating sensors are located respectively between the limit switches. The piston rod advances past a point of a decelerating sensor, triggers the sensor, and causes the decelerating solenoid valve's operating mode to change from a high speed mode to a low speed mode. The change in mode is accomplished by outgoing air being introduced so that it passes through the flow control valve thereby reducing the speed of the piston rod.

3 Claims, 1 Drawing Sheet

DECELERATING AIR PRESSURE CIRCUIT FOR AN AIR CYLINDER

FIELD OF THE INVENTION

The present invention relates to a decelerating air circuit for air cylinder utilized in an automated machine.

PRIOR ART

In general, automated machines utilize air cylinders to achieve the sliding, turning or upward and downward motions necessary in their operation. As shown FIG. 1, a constant speed control valve 3 is provided at a line between a solenoid valve 1 and an air cylinder 2 so the air cylinder is operated at a constant speed. A dog is mounted at the end of a piston rod that is attached to the air cylinder. When the dog contacts with a stopper as the piston rod advances, the piston rod is stopped. The pushing force and inertial force of the piston rod such that when it impacts with the stopper located at its stopping end causing the life of the machine to be shortened and any object carried by the machine to be damaged.

Therefore, the speed of the air cylinder is slowed as preventative measure. As a result, however, the complete motion of the piston rod and the air cylinder takes an extended period of time such that operating time is made longer. On the other hand, if the speed of the piston rod and air cylinder is increased, there exists the risk damage to the machine and any object carried.

SUMMARY OF THE INVENTION

To resolve the above problems, the purpose of the invention is to provide a decelerating air-pressure circuit for an air cylinder in which the driving range of the air cylinder is divided into high speed portion and lower speed portion and the speed of air cylinder is decelerated at the lower speed portion located near a stopper while the speed of air cylinder is fast except the lower speed portion thereby the piston rod of the air cylinder is slowly stopped at the stopper.

A decelerating air circuit having an air cylinder comprising: a driving solenoid valve having an advance mode and a withdrawal mode; a decelerating solenoid valve having a high speed mode and a low speed mode; an outlet port of said driving solenoid valve connected to said decelerating solenoid valve; a constant speed flow control valve attached to an low speed port of said decelerating solenoid valve; limit switches located respectively at an advance end and a withdrawal end of the operation of a piston rod of the air cylinder; and decelerating sensors located respectively around said limit switches.

BRIEF DESCRIPTION OF DRAWINGS

These and other features, aspects, and advantages of the present invention will become better understood with regard to the following description, appended claims, and accompanying drawings wherein:

DETAIL DESCRIPTION

Figure 1:
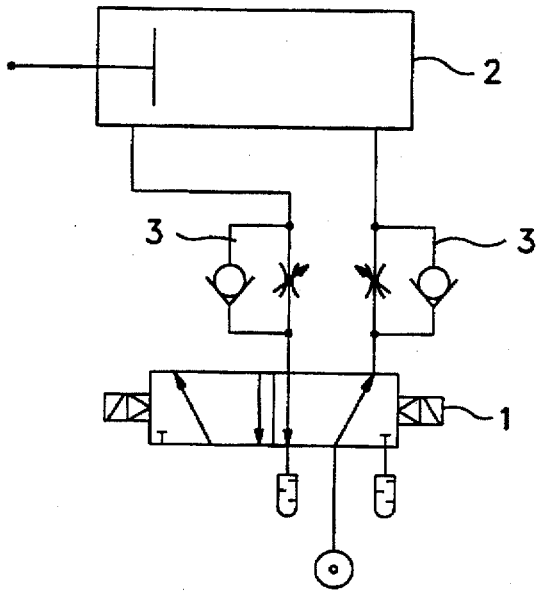
FIG. 1 (PRIOR ART)
FIG. 1 shows the prior constant speed air circuit for air cylinder.
Figure 2:
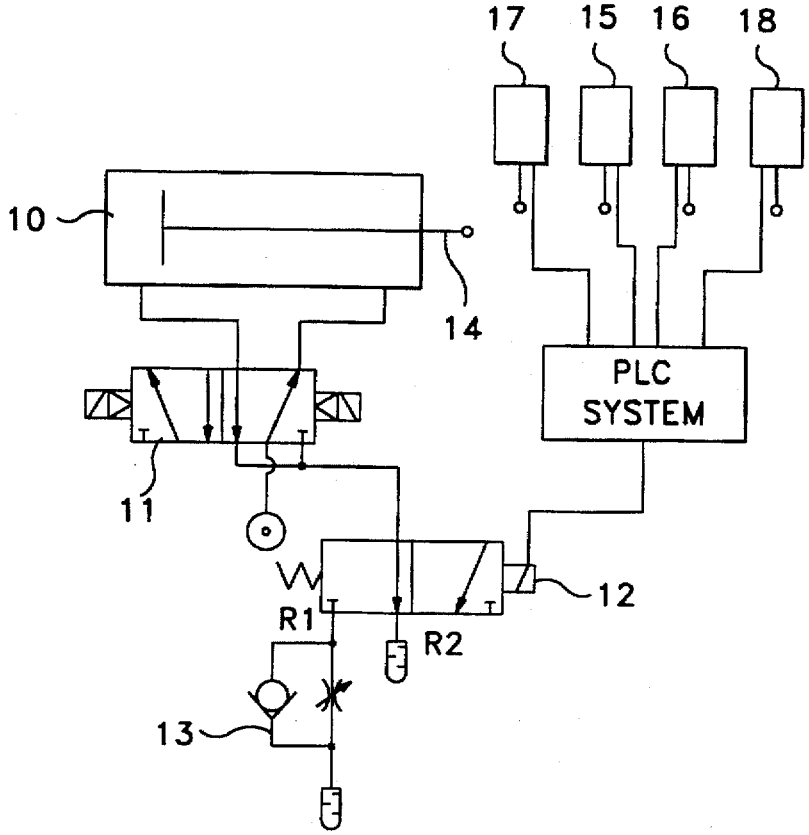
FIG. 2 shows a decelerating air circuit for air cylinder in accordance with the present invention.

In FIG. 2, is shown a decelerating air circuit for air cylinder in accordance with the present invention.

An air cylinder 10 is provided with a driving solenoid valve 11 having an advance mode (a) and a withdrawal mode (b).

A decelerating solenoid valve 12, having a high speed mode (c) and a low speed mode, is connected to an outlet port of the solenoid valve 11. A constant speed flow control valve 13 is attached to the low speed port (R1) of the solenoid valve 12.

The flow control valve 13 is comprised of a wide outlet for the high speed mode and a narrow outlet for a low speed mode through which the speed of the outgoing air flow is controlled.

Also shown in FIG. 2, are limit switches 17 and 18 also indicated by L/S-1 and L/S-4, located respectively at the advance end and the withdrawal end to the operation of the piston rod 14 of the air cylinder 10. Between the limit switches 17 and 18, there are decelerating sensors 15 and 16 which are limit switches and are also indicated by L/S-2 and L/S-3.

When the piston rod 14 is advances past the point of a decelerating sensor 16, it triggers the sensor 16, and causes the decelerating solenoid valve's 12 operating mode to change from a high speed mode (c) to a low speed mode. The change in mode is accomplished from high speed mode (c) to low speed mode by the outgoing air being introduced so that it passes through the flow control valve thereby reducing the speed of the piston rod.

The operation of the decelerating air circuit in accordance with the present invention is described as follows.

In the following table, the operating condition of the solenoid valves and limit switches is indicated on the basis of the driving range of the piston rod.

| Driving | solenoid valve made | | | limit switch | | | |
|---|---|---|---|---|---|---|---|
| range | SOLa | SOLb | SOLc | L/S-1 | L/S-2 | L/S-3 | L/S-4 |
| withdrawal | OFF | ON | OFF | ON | OFF | OFF | OFF |
| withdrawal | OFF | ON | ON | OFF | ON | OFF | OFF |
| decelerating advance | ON | OFF | ON | OFF | OFF | ON | OFF |
| decelerating advance | ON | OFF | OFF | OFF | OFF | OFF | ON |

At the start, the solenoid valve 11 is operated on the advance mode (a) and the piston rod 14 of the air cylinder 10 advances.

When the piston rod 14 triggers the decelerating sensor 16 as it advances, the high speed mode (c) of the solenoid valve 12 is off and the low speed mode is operated so the air flow is reduced in flow thereby vacuum pressure is forming in the air cylinder 10 and the advancing speed is reduced for piston rod 14.

Therefore, the piston rod 14 advanced more slowly from the location of the decelerating sensor 16 and the air cylinder 10 is goes into deceleration. When the limit switch 18 is triggered, the piston rod 14 is stopped and the solenoid valve 12 is under low speed mode.

The preferred embodiment as shown FIG. 2 forms a decelerating air circuit in which the decelerating action is established at the advance and the withdrawal ends of the operation of air cylinder 10. If necessary, however, the decelerating action can be established at either the advance end or the withdrawal end.

In case that the speed of the air cylinder 10, in the high speed mode, is too fast, a flow control valve can be provided at the port (R2) of the high speed mode(c) of solenoid valve 12 to control the speed. Furthermore, the flow control valve can be selected to have a large flow capacity.

When the speed difference of the high speed and low speed is large, it results in a vibration of the air cylinder 10. Therefore, it is necessary to control the speed difference. The decelerating distance, which is defined as a distance between the decelerating sensor 16 and the limit switch 18, depends on the speed and the weight of the carried product. According the selected decelerating distance, the decelerating sensor is mounted at an appropriate location.

Although the preferred embodiment of the present invention has been disclosed for illustrative purposes, those skilled in the art will appreciate that various modifications, additions and substitutions are possible, without departing from the scope and spirit of the present invention as disclosed in the accompanying claims.

What is claimed is:

1. A decelerating air circuit having an air cylinder comprising:

a driving solenoid valve having an advance mode and a withdrawal mode;

a decelerating solenoid valve having a high speed mode and a low speed mode;

an outlet port of said driving solenoid valve connected to said decelerating solenoid valve;

a constant speed flow control valve attached to an low speed port of said decelerating solenoid valve;

limit switches located respectively at an advance end and a withdrawal end of the operation of a piston rod of the air cylinder; and decelerating sensors located respectively between said limit switches.

2. The decelerating air circuit as claimed in claim 1 wherein, the piston rod advances past a point of a decelerating sensor, triggers said sensor, and causes the decelerating solenoid valve's operating mode to change from a high speed mode to a low speed mode by which the change in mode is accomplished from a high speed mode to low speed mode by outgoing air being introduced so that it passes through the flow control valve thereby reducing the speed of the piston rod.

3. The decelerating air circuit as claimed in claim 1, wherein, the flow control valve is further comprised of a wide outlet for the high speed mode and a narrow outlet for low speed mode through which the speed of the outgoing air flow is controlled.

* * * * *